US012805623B2

(12) United States Patent
Lee et al.

(10) Patent No.: US 12,805,623 B2
(45) Date of Patent: Nov. 24, 2026

(54) HAIR DRYER

(71) Applicant: SAMSUNG ELECTRONICS CO., LTD., Suwon-si (KR)

(72) Inventors: Hochae Lee, Suwon-si (KR); Woojin Kim, Suwon-si (KR); Jinbaek Kim, Suwon-si (KR); Jeesu Park, Suwon-si (KR); Changhoon Oh, Suwon-si (KR); Kyungmok Yoo, Suwon-si (KR); Kwango Cho, Suwon-si (KR); Joongkeun Choi, Suwon-si (KR); Qasim Khan, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 570 days.

(21) Appl. No.: 18/225,431

(22) Filed: Jul. 24, 2023

(65) Prior Publication Data

US 2024/0122328 A1 Apr. 18, 2024

Related U.S. Application Data

(63) Continuation of application No. PCT/KR2023/009417, filed on Jul. 4, 2023.

(30) Foreign Application Priority Data

Oct. 12, 2022 (KR) ..... 10-2022-0130973

(51) Int. Cl.
*A45D 20/50* (2006.01)
*A45D 20/26* (2006.01)
(Continued)

(52) U.S. Cl.
CPC ..... *A45D 20/50* (2013.01)

(58) Field of Classification Search
CPC ..... A45D 20/50; A45D 20/48; A45D 20/34; A45D 20/26; A45D 1/00; F26B 13/10; F26B 21/00
(Continued)

(56) References Cited

U.S. PATENT DOCUMENTS 5,845,656 A * 12/1998 Assmann ..... A45D 20/122 132/271
2013/0133682 A1 5/2013 Yoe et al.
(Continued)

FOREIGN PATENT DOCUMENTS

JP 50-149274 A 12/1975
KR 20-0445901 Y1 9/2009
(Continued)

OTHER PUBLICATIONS

International Search Report dated Oct. 18, 2023 for International Application No. PCT/KR2023/009417.
(Continued)

*Primary Examiner* — Deming Wan
(74) *Attorney, Agent, or Firm* — STAAS & HALSEY LLP

(57) ABSTRACT

A hair dryer including a main body; a fan inside the main body to generate a flow of air; and a nozzle connected to the main body so that the air flows into the nozzle. The nozzle includes a nozzle body having an inner space, a nozzle partition wall inside the nozzle body dividing the inner space into first and second nozzle passages, a plurality of first nozzle holes formed in the nozzle body to communicate with the first nozzle passage, and a plurality of second nozzle holes formed in the nozzle body to communicate with the second nozzle passage. The nozzle is configured so that air flowing into the first nozzle passage is discharged through the first nozzle holes in a first direction, and air flowing into
(Continued)

the second nozzle passage is discharged through the second nozzle holes in a second direction that is different from the first direction.

13 Claims, 8 Drawing Sheets

(51) Int. Cl.
*A45D 20/34* (2006.01)
*A45D 20/48* (2006.01)
*F26B 17/10* (2006.01)

(58) Field of Classification Search
USPC ..... 34/96, 99, 98; 392/380, 379
See application file for complete search history.

(56) References Cited

U.S. PATENT DOCUMENTS

| | | | | |
|---|---|---|---|---|
| 2016/0220005 | A1* | 8/2016 | Steele | A45D 20/26 |
| 2017/0042305 | A1 | 2/2017 | Nilsen | |

FOREIGN PATENT DOCUMENTS

| | | | |
|---|---|---|---|
| KR | 10-2013-0104439 | A | 9/2013 |
| KR | 10-1339760 | B1 | 12/2013 |
| KR | 10-1358844 | B1 | 2/2014 |
| KR | 20-0475837 | Y1 | 1/2015 |
| KR | 20-2016-0002177 | U | 6/2016 |
| KR | 10-2017-0054771 | A | 5/2017 |
| KR | 10-1791190 | B1 | 11/2017 |
| KR | 10-1871122 | B1 | 6/2018 |
| KR | 10-1988161 | B1 | 6/2019 |
| KR | 10-2020-0121463 | A | 10/2020 |
| KR | 10-2021-0034839 | | 3/2021 |

OTHER PUBLICATIONS

Written Opinion of the International Searching Authority dated Oct. 18, 2023 for International Application No. PCT/KR2023/009417.

Office Action dated Aug. 5, 2026 issued in KR Application No. 10-2022-0130973.

* cited by examiner

HAIR DRYER

CROSS-REFERENCE TO RELATED APPLICATION

This application is a continuation application, under 35 U.S.C. § 111(a), of international application No. PCT/KR2023/009417, filed on Jul. 4, 2023, which claims priority to Korean Patent Application No. 10-2022-0130973, filed on Oct. 12, 2022, in the Korean Intellectual Property Office, the disclosures of which are incorporated by reference herein in their entireties.

BACKGROUND

1. Field

The present disclosure relates to a hair dryer, and more specifically, to a hair dryer including a nozzle.

2. Description of the Related Art

A hair dryer is a device used to remove moisture from a user's hair as much as desired in a wet state or style a user's hair from a current shape to a desired shape.

In general, a hair dryer operates to, when a blowing fan is driven, suction an appropriate amount of air through an inlet and discharge the suctioned air through an outlet. Accordingly, the user may style the hair into a desired shape in the process of moisture remaining on the hair being evaporated or air reaching the hair.

SUMMARY

Aspects of embodiments of the disclosure will be set forth in part in the description which follows and, in part, will be apparent from the description, or may be learned by practice of the presented embodiments.

According to an embodiment of the disclosure, a hair dryer includes a main body; a fan disposed inside the main body and configured to generate a flow of air in the main body; and a nozzle connected to the main body so that the air in the main body flows into the nozzle, wherein the nozzle includes a nozzle body having an inner space, a nozzle partition wall inside the nozzle body and dividing the inner space into a first nozzle passage and a second nozzle passage, a plurality of first nozzle holes formed in the nozzle body so as to communicate with the first nozzle passage, and a plurality of second nozzle holes formed in the nozzle body so as to communicate with the second nozzle passage, and the nozzle is configured so that air flowing from the main body into the first nozzle passage is discharged through the plurality of first nozzle holes in a first direction, and air flowing from the main body into the second nozzle passage is discharged through the plurality of second nozzle holes in a second direction that is different from the first direction.

According to an embodiment of the disclosure, the nozzle may include a nozzle inlet formed in the nozzle body and through which the air flows from the main body into the nozzle, and the nozzle inlet may include a first nozzle inlet through which the air flows from the main body into the first nozzle passage, and a second nozzle inlet through which the air flows from the main body into the second nozzle passage, the second nozzle inlet being divided from the first nozzle inlet by the nozzle partition wall.

According to an embodiment of the disclosure, the main body may include a first body passage through which air moves to the first nozzle inlet, a second body passage through which air moves to the second nozzle inlet, and a body partition wall to divide the first body passage and the second body passage from one another.

According to an embodiment of the disclosure, the main body may include a first body inlet through which air flows into the first body passage, and a second body inlet through which air flows into the second body passage, the second body inlet being divided from the first body inlet by the body partition wall, and the hair dryer may further include a flow adjusting device inside the main body to adjust an amount of air flowing into the first body inlet and the second body inlet.

According to an embodiment of the disclosure, the fan may be disposed upstream of the body partition wall in the flow of air, and the flow adjusting device may include a damper disposed between the fan and the body partition wall to open and close the first body inlet and the second body inlet.

According to an embodiment of the disclosure, the hair dryer may further include a temperature adjusting device inside the main body to adjust a temperature of the air moving through the first body passage or the second body passage.

According to an embodiment of the disclosure, the temperature adjusting device may include a heater disposed in the first body passage to heat the air moving through the first body passage.

According to an embodiment of the disclosure, the nozzle partition wall may be connected to the body partition wall.

According to an embodiment of the disclosure, the first nozzle passage may be formed between a first end at which the first nozzle inlet is disposed and a second end located opposite to the first end, and the nozzle partition wall may extend from the first end to the second end.

According to an embodiment of the disclosure, the nozzle may include a communication portion in the inner space and through which the first nozzle passage and the second nozzle passage communicate.

According to an embodiment of the disclosure, the nozzle may include a first nozzle, and a second nozzle, spaced apart from the first nozzle.

According to an embodiment of the disclosure, the plurality of second nozzle holes may be open toward a direction opposite to a direction toward which the plurality of first nozzle holes are open.

According to an embodiment of the disclosure, first nozzle holes among the plurality of first nozzle holes may be shaped differently than second nozzle holes among the plurality of second nozzle holes.

According to an embodiment of the disclosure, the plurality of first nozzle holes may each have a circular shape or a slit shape.

According to an embodiment of the disclosure, the nozzle body may include a first sidewall in which the plurality of first nozzle holes are formed, a second sidewall in which the plurality of second nozzle holes are formed, the second sidewall being opposite to the first sidewall, a bottom wall connecting the first sidewall and the second sidewall, and a top wall connecting the first sidewall and the second sidewall opposite to the bottom wall, wherein the nozzle partition wall extends between the bottom wall and the top wall.

BRIEF DESCRIPTION OF THE DRAWINGS

These and/or other embodiments of the disclosure will become apparent and more readily appreciated from the following description of the embodiments, taken in conjunction with the accompanying drawings of which.

DETAILED DESCRIPTION

Figure 1:
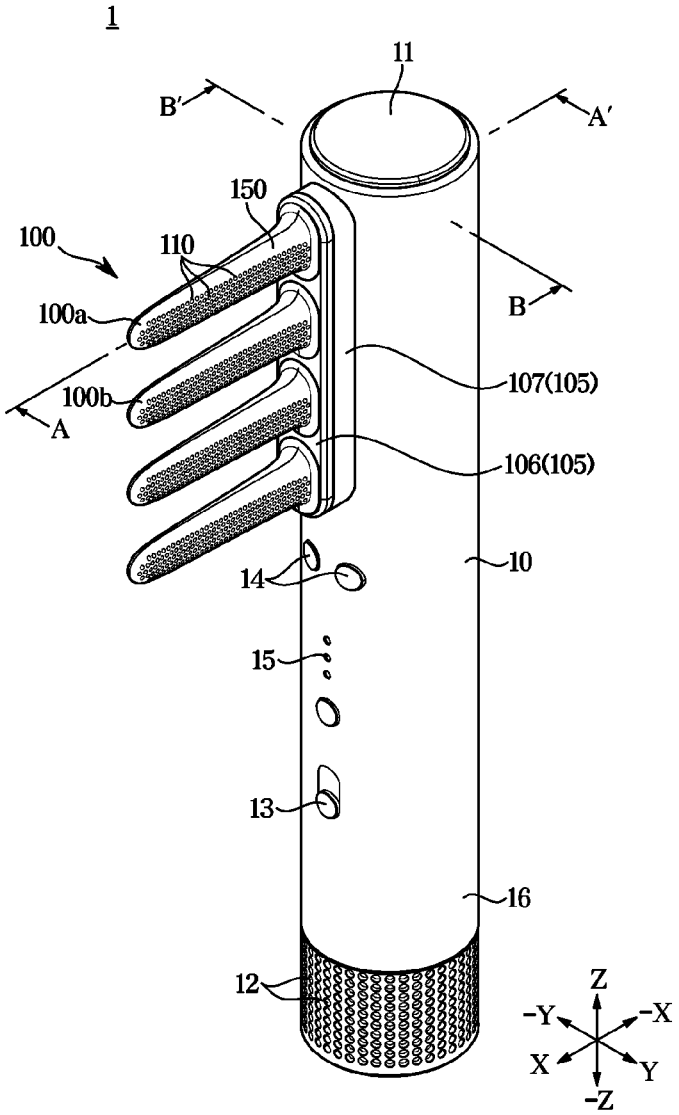
FIG. 1 is a perspective view illustrating a hair dryer according to an embodiment of the present disclosure.

Embodiments described in the specification and configurations shown in the accompanying drawings are merely exemplary examples of the present disclosure, and various modifications may replace the embodiments and the drawings of the present disclosure at the time of filing of the present application.

Further, identical symbols or numbers in the drawings of the present disclosure denote components or elements configured to perform substantially identical functions.

Further, terms used herein are only for the purpose of describing particular embodiments and are not intended to limit to the present disclosure. The singular form is intended to include the plural form as well, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Further, it should be understood that, although the terms "first," "second," etc. may be used herein to describe various elements, the elements are not limited by the terms, and the terms are only used to distinguish one element from another. For example, a first element could be termed a second element, and similarly, a second element could be termed a first element without departing from the scope of the present disclosure. The term "and/or" includes combinations of one or all of a plurality of associated listed articles.

The terms "front", "upper", "lower", "left", and "right" as herein used are defined with respect to the drawings, but the terms may not restrict the shape and position of the respective components.

Embodiments of the disclosure may provide a hair dryer including a nozzle capable of discharging air in various directions. Embodiments of the disclosure may provide a hair dryer including a nozzle capable of adjusting the temperature according to a direction. Embodiments of the disclosure may provide a hair dryer including a nozzle capable of adjusting the flow rate according to a direction. The technical objectives of the present disclosure are not limited to those described herein, and other objectives may become apparent to those of ordinary skill in the art based on the following description.

Hereinafter, embodiments according to the disclosure will be described in detail with reference to the accompanying drawings.

Figure 2:
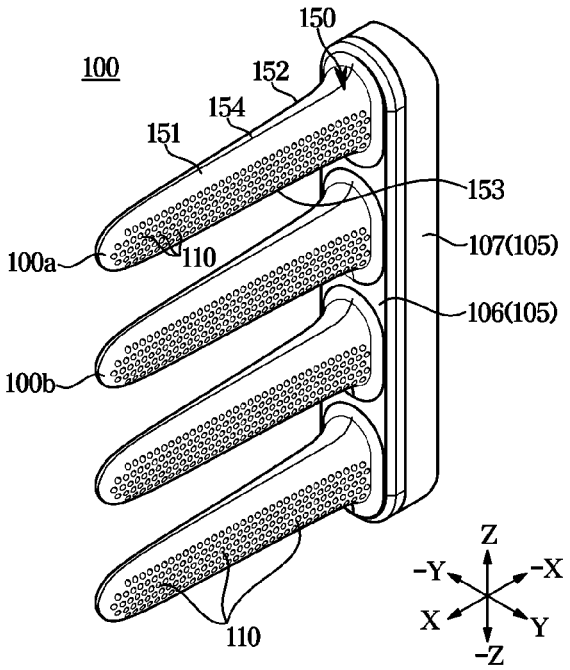
FIG. 2 is a perspective view illustrating a nozzle according to an embodiment of the present disclosure.
Figure 3:
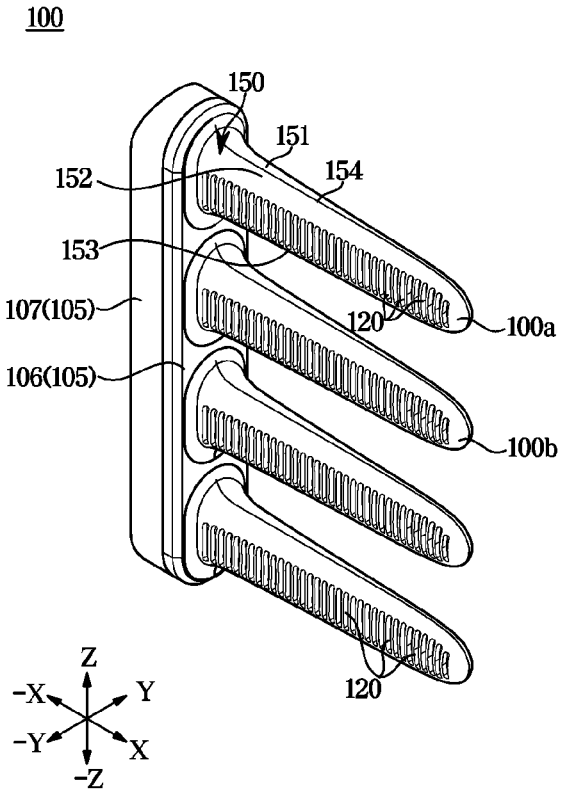
FIG. 3 is a perspective view illustrating a nozzle according to an embodiment of the present disclosure.

FIG. 1 is a perspective view illustrating a hair dryer according to an embodiment of the present disclosure. FIG. 2 is a perspective view illustrating a nozzle according to an embodiment of the present disclosure. FIG. 3 is a perspective view illustrating a nozzle according to an embodiment of the present disclosure.

A hair dryer 1 may refer to any type of device that suctions and discharges air. The hair dryer 1 may refer to any type of device that uses wind to dry or style a user's hair.

The hair dryer 1 may include a main body 10 and a nozzle 100 connected to the main body 10 and discharging air toward the outside. Air may be introduced into an intake port of the main body 10 and discharged to the outside through nozzle holes 110 and 120 formed in the nozzle 100.

When the hair dryer 1 is used, the nozzle 100 may be positioned toward the user's head. Hereinafter, for the sake of convenience of description, the direction in which the nozzle 100 extends is referred to as "forward", and signified as the +X axis in the drawings. That is, the nozzle 100 may be disposed on the front of the main body 10.

In addition, when the hair dryer 1 is used, the user may use the air dryer 1 by holding a handle 16 located at a lower portion of the main body 10. Hereinafter, for the sake of convenience of description, a part in which the handle 16 is formed in the main body 10 is referred to as a "lower part", and is signified as the −Z axis in the drawings.

The hair dryer 1 may be provided with a power button 13. The user may turn the hair dryer 1 on or off by manipulating the power button 13.

The hair dryer 1 may be provided with a manipulation button 14. The user may adjust the temperature or flow rate of air discharged from the hair dryer 1 by manipulating the manipulation button 14.

In the drawing, the power button 13 and the manipulation button 14 are illustrated as being provided on the outer circumferential surface of the main body 10 as an example, but the present disclosure is not limited thereto. For example, the power button 13 and/or the manipulation button 14 may be provided in various positions as long as it can control a fan unit 20, a flow adjusting device 31, and a temperature adjusting device 41 inside the main body 10.

The hair dryer 1 may be provided with an indicator light 15. The indicator light 15 may indicate whether the hair dryer 1 is in operation, and whether the flow rate and/or temperature are adjusted.

The main body 10 may be provided to accommodate internal parts of the hair dryer 1. The main body 10 may include an inner space. A through hole may be formed inside the main body 10.

The main body 10 may have a substantially cylindrical shape. The main body 10 may extend in an upper-lower side direction.

The main body 10 may include a body cover 11. The body cover 11 may be disposed on an upper side of the main body 10 to cover an inner space of the main body 10.

The main body 10 may include an intake port 12. The intake port 12 may be provided such that external air is suctioned into the main body 10. The intake port 12 may be provided on the lower side of the main body 10. The intake port 12 may be provided to pass through the main body 10.

In this drawing, the intake port 12 is provided on the lower side of the main body 10 as an example, but the present disclosure is not limited thereto. For example, the intake port 12 may be provided on the upper side of the main body 10 or may be provided on the rear side of the main body 10.

Air introduced into the main body 10 through the intake port 12 may be discharged to the outside through the nozzle 100. The nozzle 100 may include nozzle holes 110 and 120 provided to discharge air to the outside.

The nozzle 100 may be connected to the main body 10. The nozzle 100 may be coupled to the main body 10. However, the present disclosure is not limited thereto, and the nozzle 100 may be integrally formed with the main body 10.

The nozzle 100 may extend from the main body 10 toward the front. The nozzle 100 may extend from the main body 10 in a first direction +X. In this drawing, the first direction +X is a direction toward the front, and may refer to the +X axis.

The nozzle 100 may include a nozzle body 150. The nozzle body 150 may form the appearance of the nozzle 100. The nozzle body 150 may be provided to form an inner space S of the nozzle 100. A passage of the nozzle 100 may be provided in the inner space S of the nozzle 100. The air introduced into the nozzle 100 may move along the passage of the nozzle 100 and flow out through the nozzle holes 110 and 120.

The nozzle body 150 may include a first sidewall 151 and a second sidewall 152 positioned opposite to the first sidewall 151. The first sidewall 151 may be disposed on the left side. The first sidewall 151 may be disposed to face in the direction of the +Y axis. The first sidewall 151 and/or the second sidewall 152 may include an inner surface provided to form the inner space S.

The nozzle body 150 may include a top wall 154 and a bottom wall 153 positioned opposite to the top wall 154. The top wall 154 may be disposed on the upper side. The top wall 154 may be positioned to face in the direction of the +Z axis. The top wall 154 and/or the bottom wall 153 may include an inner surface provided to form the inner space S.

The top wall 154 and/or the bottom wall 153 may be provided to connect the first sidewall 151 and the second sidewall 152. The first sidewall 151, the second sidewall 152, the top wall 154, and the bottom wall 153 may be coupled to each other. The first sidewall 151, the second sidewall 152, the top wall 154, and the bottom wall 153 may be integrally formed with each other.

The nozzle 100 may include nozzle holes 110 and 120 provided to allow air moving in the inner space S of the nozzle body 150 to be discharged the outside.

Referring to FIG. 2, the nozzle holes 110 and 120 may include a first nozzle hole 110. The first nozzle hole 110 may be provided to allow air to be discharged in a second direction +Y. The second direction +Y may be a direction different from the first direction +X. The second direction +Y may be a direction perpendicular to the first direction +X. The second direction +Y may be a direction toward the left. The second direction +Y may be a direction of the +Y axis. From the perspective of a user, the second direction +Y may be a direction toward the scalp.

The first nozzle hole 110 may be provided in the nozzle body 150. The first nozzle hole 110 may be provided in the first sidewall 151. The first nozzle hole 110 may be formed to pass through the first sidewall 151.

The first nozzle hole 110 may have a circular shape. However, the present disclosure is not limited thereto, and the first nozzle hole 110 may have various shapes. For example, the first nozzle hole 110 may have a polygonal shape or a slit shape according to circumstances.

The first nozzle hole 110 may be provided in plural. The plurality of first nozzle holes 110 may be arranged in a front-rear direction and/or an upper-lower direction.

Referring to FIG. 3, the nozzle holes 110 and 120 may include a second nozzle hole 120. The second nozzle hole 120 may be provided to allow air to be discharged in a third direction −Y. The third direction −Y may be a different direction from the first direction +X. The third direction −Y may be a direction perpendicular to the first direction +X. The third direction −Y may be a direction toward the right side. The third direction −Y may be a direction of the −Y axis. From the perspective of a user, the third direction −Y may be a direction toward hair.

The third direction −Y may be a direction different from the second direction +Y. Therefore, the user may adjust the air to be discharged in several directions at the same time. The third direction −Y may be opposite to the second direction +Y.

The second nozzle hole 120 may be provided in the nozzle body 150. The second nozzle hole 120 may be provided in the second sidewall 152. The second nozzle hole 120 may be formed to pass through the second sidewall 152.

The second nozzle hole 120 may have a shape different from that of the first nozzle hole 110. Accordingly, the user may adjust the air to be discharged through the first nozzle hole 110 and/or the second nozzle hole 120 according to circumstances. However, the present disclosure is not limited thereto, and the second nozzle hole 120 may have the same shape as the first nozzle hole 110.

The second nozzle hole 120 may have a slit shape. However, the present disclosure is not limited thereto, and the second nozzle hole 120 may have various shapes. For example, the first nozzle hole 110 may have a circular shape, a polygonal shape, or the like to suit circumstances.

The second nozzle hole 120 may be provided in plural. The plurality of second nozzle holes 120 may be arranged in a front-rear direction and/or an upper-lower direction.

The nozzle 100 may include a first nozzle **100*a* and a second nozzle 100*b*. The second nozzle 100*b* may be spaced apart from the first nozzle 100*a*. The second nozzle 100*b* may be arranged apart from the first nozzle 100*a* in the Z-axis direction. The nozzle 100** may be provided in a brush shape to improve convenience of use.

The nozzle 100 may include a connecting portion 105. The connecting portion 105 may be provided to connect the nozzle 100 and the main body 10.

The connecting portion 105 may include a connection plate 106. The connection plate 106 may be provided to connect the first nozzle **100*a* and the second nozzle 100*b*. The connection plate 106** may extend along the Z-axis direction.

The connecting portion 105 may include a coupling plate 107. The coupling plate 107 may connect the connection plate 106 to the main body 10. The coupling plate 107 may extend along the circumference of the connection plate 106.

Figure 4:
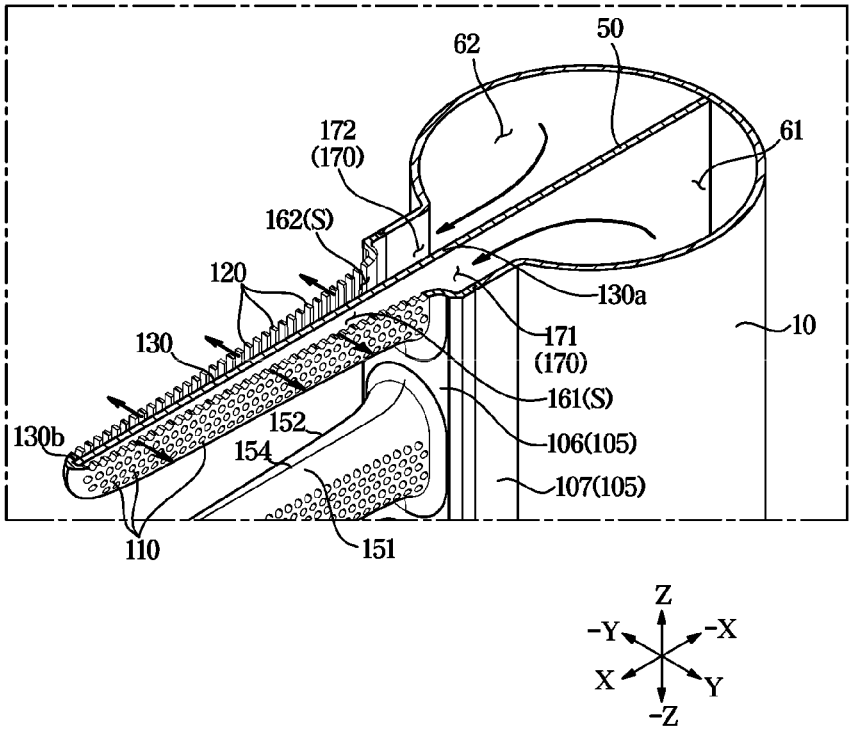
FIG. 4 is a cross-sectional view of the hair dryer taken along line A-A' shown in FIG. 1.
Figure 5:
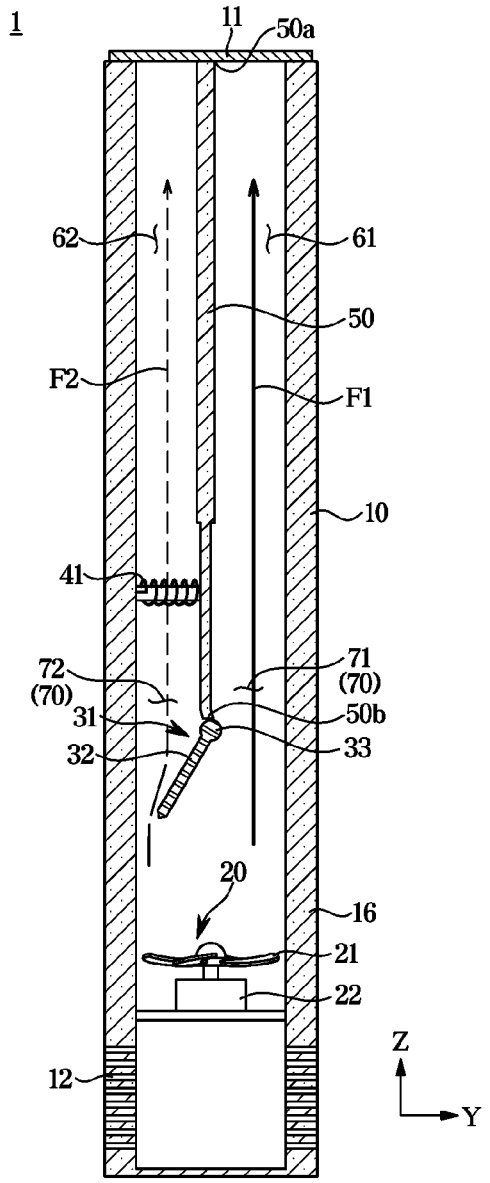
FIG. 5 is a cross-sectional view of the hair dryer taken along line B-B' shown in FIG. 1.

FIG. 4 is a cross-sectional view of the hair dryer shown in FIG. 1 taken along line A-A'. FIG. 5 is a cross-sectional view of the hair dryer shown in FIG. 1 taken along line B-B'.

The nozzle 100 may include a nozzle partition wall 130. The nozzle partition wall 130 may be provided inside the nozzle body 150 to partition the inner space S. The nozzle partition wall 130 may partition the passage. The nozzle partition wall 130 may be disposed between the first nozzle hole 110 and the second nozzle hole 120 to separate air discharged from the first nozzle hole 110 and air discharged from the second nozzle hole 120.

The nozzle 100 may include a first nozzle passage 161 provided to allow air to move to the first nozzle hole 110 and a second nozzle passage 162 provided to allow air to move to the second nozzle hole 120. The first nozzle passage 161 and the second nozzle passage 162 may be provided in the inner space S of the nozzle body 150.

The nozzle 100 may include a nozzle inlet 170 through which air is introduced from the main body 10. The nozzle inlet 170 may include a first nozzle inlet 171 provided to allow air to flow into the first nozzle passage 161 and a second nozzle inlet 172 provided to allow air to flow into the second nozzle passage 162.

The nozzle partition wall 130 may divide the first nozzle passage 161 from the second nozzle passage 162. The nozzle partition wall 130 may divide the first nozzle inlet 171 from the second nozzle inlet 172.

The nozzle partition wall 130 may extend from one end of the nozzle 100, at which the nozzle inlet 170 is disposed, to the other end of the nozzle 100 located at a side opposite to the one end of the nozzle 100.

The first nozzle passage 161 may be formed between a first end 161*a*, at which the first nozzle inlet 171 is disposed, and a second end 161*b* located at a side opposite to the first end 161*a*. The nozzle partition wall 130 may extend from the first end 161*a* of the first nozzle passage 161 to the second end 161*b* of the first nozzle passage 161. The second nozzle passage 162 may be formed between a first end 162*a*, at which the second nozzle inlet 172 is disposed, and a second end 162*b* located at a side opposite to the first end 162*a*.

The nozzle partition wall 130 may be provided to protrude from the bottom wall 153 and be in contact with the top wall 154. The nozzle partition wall 130 may extend between the top wall 154 and the bottom wall 153 forming the inner space S to partition the inner space S.

The nozzle partition wall 130 may divide the first nozzle inlet 171 and the second nozzle inlet 172, thereby preventing air flowing into the first nozzle passage 161 and air flowing into the second nozzle passage 162 from being mixed with each other. Accordingly, the air introduced into the first nozzle passage 161 and the air introduced into the second nozzle passage 162 may have different temperatures and flow rates.

The nozzle partition wall 130 may divide the first nozzle passage 161 and the second nozzle passage 162, thereby preventing air moving in the first nozzle passage 161 and air moving in the second nozzle passage 162 from being mixed with each other. Accordingly, the air moving in the first nozzle passage 161 and the air moving in the second nozzle passage 162 may be respectively discharged to the first nozzle hole 110 and the second nozzle hole 120 while having different temperatures and flow rates.

That is, the air discharged through the first nozzle hole 110 and the air discharged through the second nozzle hole 120 may have different temperatures and flow rates. Therefore, the user may adjust the properties of the discharged air according to the direction.

Referring to FIG. 5, the fan unit 20 may be provided inside the main body 10. The fan unit 20 may include a fan 21 generating an air flow, a motor 22 supplying power to the fan 21, and a power supply (not shown) supplying power to the motor 22. The power supply (not shown) may be disposed inside or outside the main body 10.

By the rotation of the fan 21, air may be suctioned into the intake port 12, and the suction air may be discharged through the nozzle holes 110 and 120. Alternatively, air may be suctioned into the nozzle holes 110 and 120, and the suctioned air may be discharged through the intake port 12.

Inside the main body 10, provided may be a first body passage 61 into which at least a portion of the air generated by the fan unit 20 is introduced and a second body passage 62 into which the remaining portion is introduced.

The first main body passage 61 may be provided such that air flows into the first nozzle inlet 171 and moves to the first nozzle passage 161. The first main body passage 61 may be connected to the first nozzle passage 161.

The second body passage 62 may be provided such that air flows into the second nozzle inlet 172 and moves to the second nozzle passage 162. The second body passage 62 may be connected to the second nozzle passage 162.

The main body 10 may include a body inlet 70 into which air caused to flow by the fan unit 20 is introduced. The body inlet 70 includes a first body inlet 71 provided to allow air to flow into the first body passage 61 and a second body inlet 72 provided to allow air to flow into the second body passage 62.

A body partition wall 50 may divide the first body passage 61 and the second body passage 62. The body partition wall 50 may divide the first body inlet 71 and the second body inlet 72.

The first body passage 61 may be formed between the first body inlet 71 and the body cover 11. The body partition wall 50 may extend from one end of the first body passage 61 to the other end of the first body passage 61.

Inside the main body 10, provided may be a flow adjusting device 31. The flow adjusting device 31 may adjust the flow rate of air flowing into the first body passage 61 and the second body passage 62. The flow adjusting device 31 may adjust the flow rate of air discharged through the first nozzle hole 110 and the second nozzle hole 120.

The flow adjusting device 31 may include a damper 31. The damper 31 may be disposed between the fan 21 and the body partition wall 50. The damper 31 may be provided between the fan 21 and the body inlet 70. The damper 31 may adjust the flow rate of air introduced into the first body inlet 71 and the second body inlet 72.

For example, when the damper 31 closes the first body inlet 71, air may be introduced into the second body inlet 72. Alternatively, referring to FIG. 5, when the damper 31 closes a part of the second body inlet 72, the flow rate of air F1 flowing into the first body inlet 71 may be greater than the flow rate of air F2 introduced into the second body inlet 72.

The damper 31 may include a plate 32 that is rotatable between the first body inlet 71 and the second body inlet 72. The plate 32 may be provided to correspond to the shape of the first body inlet 71 and/or the second body inlet 72. For example, the plate 32 may have a semicircular shape.

The damper 31 may include a rotating axis 33 connected to the plate 32. The plate 32 may rotate according to the rotating axis 33. The rotating axis 33 may extend along the body partition wall 50. A first end 50*a* of the body partition wall may contact the body cover 11, and the rotating axis 33 may be provided to be in contact with a second end 50*b* of the body partition wall 50.

On the other hand, the description is made in relation that the flow adjusting device 31 uses the damper 31 to adjust the flow rates of air F1 and F2 introduced into the first body passage 61 or the second body passage 62 in an air flow generated by a single fan 21 as an example, but the present disclosure is not limited thereto.

For example, the fan unit 20 may include a first fan (not shown) that generates a flow that allows air to be introduced into the first body passage 61 and a second fan (not shown)

that generates a flow that allows air to be introduced into the second body passage 62. The first fan (not shown) may be disposed adjacent to the first body inlet 71, and the second fan (not shown) may be disposed adjacent to the second body inlet 72.

Alternatively, the flow adjusting device may be implemented in various ways as long as it can adjust the flow rate of air introduced into the first body passage 61 and the second body passage 62.

Inside the main body 10, provided may be the temperature adjusting device 41. The temperature adjusting device 41 may control the temperature of air introduced into the first body passage 61 and/or the second body passage 62. The temperature adjusting device 41 may adjust the temperature of air discharged through the first nozzle hole 110 and/or the second nozzle hole 120.

The temperature adjusting device 41 may include a heater 41 provided to heat air. For example, the heater 41 may be provided with a coil or a thermoelectric element.

The heater 41 may be provided in the first body passage 61 and/or the second body passage 62 to heat air moving through the first body passage 61 and/or the second body passage 62. Referring to FIG. 5 as an example, the heater 41 may be provided in the second body passage 62 to heat air discharged through the second nozzle hole 120.

Meanwhile, in the drawings, the temperature adjusting device 41 is illustrated as being provided with a single heater 41, but the present disclosure is not limited thereto.

For example, the temperature adjusting device 41 may include a first heater provided in the first body passage 61 and a second heater provided in the second body passage 62.

Alternatively, the temperature adjusting device may be implemented in various ways as long as it can adjust the temperature of the air moving through the first body passage 61 and the second body passage 62.

The body partition wall 50 and the nozzle partition wall 130 may be connected to each other. The body partition wall 50 and the nozzle partition wall 130 may be integrally formed with each other. However, the present disclosure is not limited thereto, and the body partition wall 50 and the nozzle partition wall 130 may be coupled to each other.

Figure 6:
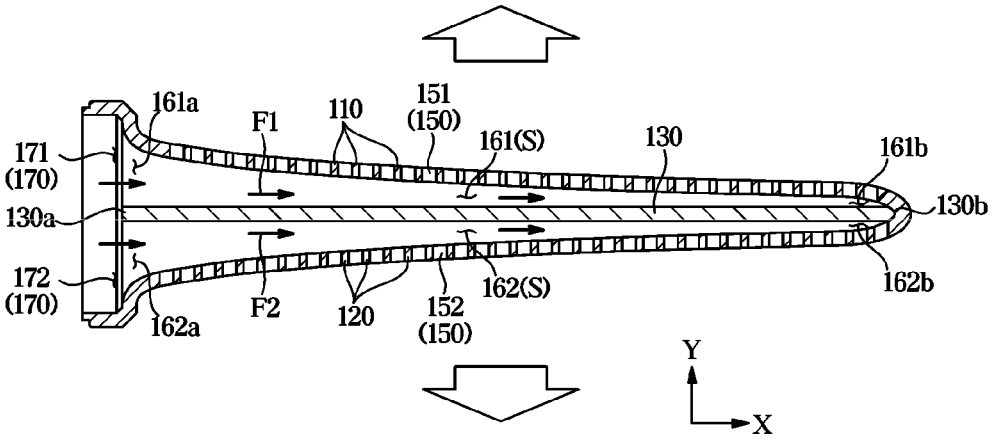
FIG. 6 is a cross-sectional view illustrating air being discharged through a nozzle hole of a nozzle according to an embodiment of the present disclosure.
Figure 7:
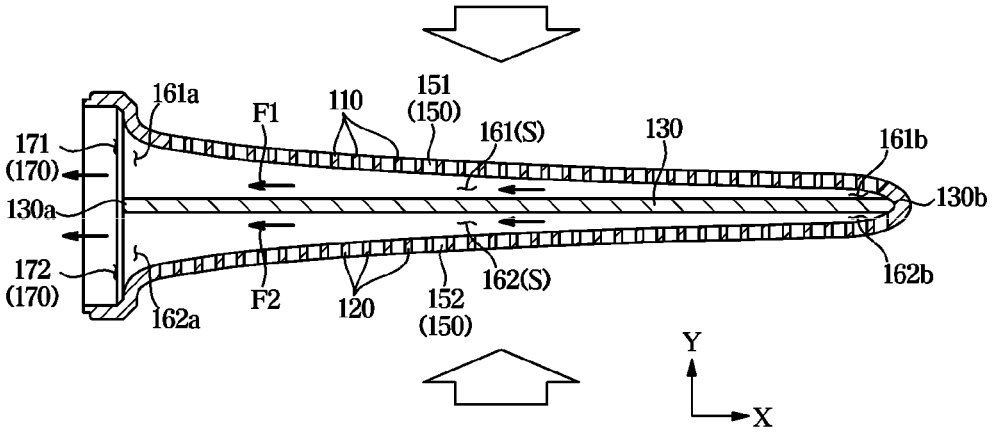
FIG. 7 is a cross-sectional view illustrating air being suctioned into a nozzle hole of a nozzle according to an embodiment of the present disclosure.
Figure 8:
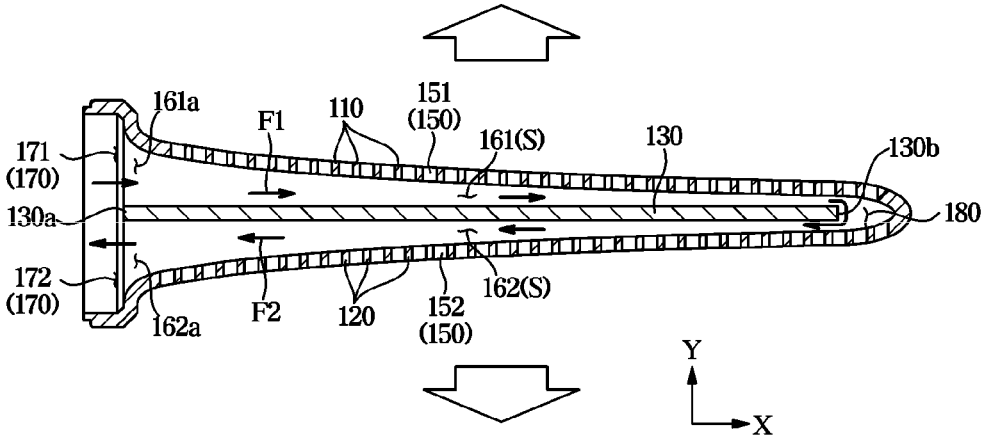
FIG. 8 is a cross-sectional view illustrating air being discharged through a nozzle hole of a nozzle according to an embodiment of the present disclosure.

FIG. 6 is a cross-sectional view illustrating air being discharged through a nozzle hole of a nozzle according to an embodiment of the present disclosure. FIG. 7 is a cross-sectional view illustrating air being suctioned into a nozzle hole of a nozzle according to an embodiment of the present disclosure. FIG. 8 is a cross-sectional view illustrating air being discharged through a nozzle hole of a nozzle according to an embodiment of the present disclosure.

Referring to FIG. 6, air F1 introduced into the first nozzle inlet 171 may be moved along the first nozzle passage 161 and discharged to the outside through the first nozzle hole 110. In this case, the first nozzle hole 110 may be disposed to face the user's scalp.

Air F2 introduced into the second nozzle inlet 172 may be moved along the second nozzle passage 162 and discharged to the outside through the second nozzle hole 120. In this case, the second nozzle hole 120 may be disposed to face the user's hair, and the temperature of the air F2 discharged through the second nozzle hole 120 may be set to a degree high enough to easily dry the hair.

The air F1 and the air F2 may be simultaneously discharged from the first nozzle hole 110 and the second nozzle hole 120 toward the second direction +Y and the third direction −Y, respectively.

That is, the user may simultaneously dry the scalp and the hair with the air F1 discharged through the first nozzle hole 110 and the air F2 discharged through the second nozzle hole 120. In addition, the temperature and the flow rate of each air F1 or F2 may be independently adjusted.

Referring to FIG. 7, external air may be suctioned through the first nozzle hole 110 into the nozzle 100 and move along the first nozzle passage 161 to the first nozzle inlet 171. Thereafter, the air may be moved to the first main body passage 61 of the main body 10 and discharged to the outside through the intake port 12.

External air may be suctioned through the second nozzle hole 120 into the nozzle 100 and moved along the second nozzle passage 162 to the second nozzle inlet 172. Thereafter, the air may be moved to the second main body passage 62 of the main body 10 and discharged to the outside through the intake port 12.

That is, the scalp and the hair may also be dried by suctioning air into the nozzle holes 110 and 120.

Referring to FIG. 8, the nozzle 100 may include a communication portion 180 provided such that the first nozzle passage 161 and the second nozzle passage 162 communicate with each other. Air moving through the first nozzle passage 161 and air moving through the second nozzle passage 162 may be mixed by the communication portion 180. The communication portion 180 may connect the first nozzle passage 161 and the second nozzle passage 162.

The communication portion 180 may be provided in the inner space S of the nozzle body 150. The communication portion 180 may be formed in a portion in which the nozzle partition wall 130 is not provided.

The nozzle partition wall 130 extends between a first end 130*a* to a second end 130*b*. The communication portion 180 may be disposed adjacent to the second end 130*b* of the nozzle partition wall 130. In the drawing, the communication portion 180 is illustrated as being disposed adjacent to the other end of the nozzle 100, but the present disclosure is not limited thereto.

For example, the communication portion 180 may be provided at a different location in the inner space S. Alternatively, the communication portion 180 may be provided in the shape of a through hole passing through the nozzle partition wall 130.

Air F1 introduced into the first nozzle inlet 171 may be moved along the first nozzle passage 161, and some of the air F1 may be discharged through the first nozzle hole 110. The remaining air F2 may be moved through the communication portion 180 to the second nozzle passage 162 and discharged through the second nozzle hole 120.

The embodiment of FIGS. 6 to 8 may be combined with the embodiments of FIGS. 1 to 5.

According to the concept of the present disclosure, since air is discharged in various directions, the convenience of using a hair dryer can be improved.

According to the concept of the present disclosure, since the temperature is adjusted according to the direction, the convenience of using the hair dryer can be improved.

According to the concept of the present disclosure, since the flow rate is adjusted according to the direction, the convenience of using the hair dryer can be improved.

Embodiments of the disclosure may provide a hair dryer including a main body; a fan disposed inside the main body and generating air flow; and a nozzle connected to the main body and discharging air to the outside. The nozzle may include a nozzle body forming a passage extending from the main body in a first direction, a first nozzle hole provided in the nozzle body and opening in a second direction perpendicular to the first direction, a second nozzle hole provided in the nozzle body and opening in a third direction opposite to the second direction, and a nozzle partition wall provided in the nozzle body to partition the passage, and disposed between the first nozzle hole and the second nozzle hole while extending in the first direction.

The nozzle may further include a nozzle inlet formed in the nozzle body and provided to allow air to be introduced from the main body, a first nozzle passage provided to allow at least a portion of the air introduced through the nozzle inlet to move to the first nozzle hole, and a second nozzle passage provided to allow a remaining portion of the air introduced through the nozzle inlet to move to the second nozzle hole.

The first nozzle passage may be formed between one end at which the nozzle inlet is disposed and the other end opposite to the one end, and the nozzle partition wall may extend from the one end to the other end.

Embodiments of the disclosure may provide a hair dryer including: a main body; a temperature adjusting device disposed inside the main body; and a nozzle connected to the main body and discharging air to the outside. The nozzle may include a first nozzle inlet into which air is introduced from the main body, a second nozzle inlet into which air is introduced from the main body, a first nozzle hole provided to allow the air introduced into the first nozzle inlet to be discharged in one direction, a second nozzle hole provided to allow the air introduced into the second nozzle inlet to be discharged in a direction different from the one direction, and a nozzle partition wall dividing the first nozzle inlet from the second nozzle inlet.

The temperature adjusting device may include a heater provided to heat air introduced into the first nozzle inlet.

The effects of the present invention are not limited to those described above, and other effects not described above will be clearly understood by those skilled in the art from the above detailed description.

A specific shape and a specific direction of a washing machine have been described above with reference to the accompanying drawings, but the present disclosure may be variously modified and changed by those skilled in the art, and the modifications and changes should be interpreted as being included in the scope of the present disclosure.

What is claimed is:

1. A hair dryer comprising:
a main body;
a fan disposed inside the main body and configured to generate a flow of air in the main body; and
a nozzle connected to the main body so that the air in the main body flows into the nozzle,
wherein the nozzle includes:
a nozzle body having an inner space,
a nozzle partition wall inside the nozzle body and dividing the inner space into a first nozzle passage and a second nozzle passage,
a plurality of first nozzle holes formed in the nozzle body so as to communicate with the first nozzle passage, and
a plurality of second nozzle holes formed in the nozzle body so as to communicate with the second nozzle passage, the nozzle is configured so that
air flowing from the main body into the first nozzle passage is discharged through the plurality of first nozzle holes in a first direction, and
air flowing from the main body into the second nozzle passage is discharged through the plurality of second nozzle holes in a second direction that is different from the first direction,
the nozzle includes:
a nozzle inlet formed in the nozzle body and through which the air flows from the main body into the nozzle, and the nozzle inlet includes:
a first nozzle inlet through which the air flows from the main body into the first nozzle passage, and
a second nozzle inlet through which the air flows from the main body into the second nozzle passage,
the second nozzle inlet being divided from the first nozzle inlet by the nozzle partition wall, and
the main body includes:
a first body passage through which air moves to the first nozzle inlet,
a second body passage through which air moves to the second nozzle inlet, and
a body partition wall to divide the first body passage and the second body passage from one another.

2. The hair dryer of claim 1, wherein
the main body includes:
a first body inlet through which air flows into the first body passage, and
a second body inlet through which air flows into the second body passage, the second body inlet being divided from the first body inlet by the body partition wall, and the hair dryer further comprises:
a flow adjusting device inside the main body to adjust an amount of air flowing into the first body inlet and the second body inlet.

3. The hair dryer of claim 2, wherein
the fan is disposed upstream of the body partition wall in the flow of air, and
the flow adjusting device includes:
a damper disposed between the fan and the body partition wall to open and close the first body inlet and the second body inlet.

4. The hair dryer of claim 1, further comprising:
a temperature adjusting device inside the main body to adjust a temperature of the air moving through the first body passage or the second body passage.

5. The hair dryer of claim 4, wherein
the temperature adjusting device includes:
a heater disposed in the first body passage to heat the air moving through the first body passage.

6. The hair dryer of claim 1, wherein
the nozzle partition wall is connected to the body partition wall.

7. The hair dryer of claim 1, wherein
the first nozzle passage is formed between a first end at which the first nozzle inlet is disposed and a second end located opposite to the first end, and
the nozzle partition wall extends from the first end to the second end.

8. The hair dryer of claim 1, wherein
the nozzle includes:
a communication portion in the inner space and through which the first nozzle passage and the second nozzle passage communicate.

9. The hair dryer of claim 1, wherein
the nozzle includes:
a first nozzle, and
a second nozzle, spaced apart from the first nozzle.

10. The hair dryer of claim 1, wherein
the plurality of second nozzle holes are open toward a direction opposite to a direction toward which the plurality of first nozzle holes are open.

11. The hair dryer of claim 1, wherein first nozzle holes among the plurality of first nozzle holes are shaped differently than second nozzle holes among the plurality of second nozzle holes.

12. The hair dryer of claim 1, wherein the plurality of first nozzle holes each have a circular shape or a slit shape.

13. The hair dryer of claim 1, wherein the nozzle body includes:

a first sidewall in which the plurality of first nozzle holes are formed, a second sidewall in which the plurality of second nozzle holes are formed, the second sidewall being opposite to the first sidewall, a bottom wall connecting the first sidewall and the second sidewall, and a top wall connecting the first sidewall and the second sidewall opposite to the bottom wall, wherein the nozzle partition wall extends between the bottom wall and the top wall.

* * * * *